US011746570B2

(12) United States Patent
Escamilla Hernandez et al.

(10) Patent No.: US 11,746,570 B2
(45) Date of Patent: Sep. 5, 2023

(54) VEHICLE DOOR LATCH WITH OVERRIDE FEATURE

(71) Applicant: Inteva Products, LLC, Troy, MI (US)

(72) Inventors: Manuel Antonio Escamilla Hernandez, Chihuahua (MX); Eduardo Estrada de Leon, Chihuahua (MX)

(73) Assignee: INTEVA PRODUCTS, LLC, Troy, MI (US)

( * ) Notice: Subject to any disclaimer, the term of this patent is extended or adjusted under 35 U.S.C. 154(b) by 27 days.

(21) Appl. No.: 17/187,756

(22) Filed: Feb. 27, 2021

(65) Prior Publication Data

US 2022/0275668 A1 Sep. 1, 2022

(51) Int. Cl.
*E05B 81/16* (2014.01)
*E05B 77/26* (2014.01)
*E05B 77/28* (2014.01)

(52) U.S. Cl.
CPC ..... *E05B 81/16* (2013.01); *E05B 77/26* (2013.01); *E05B 77/283* (2013.01)

(58) Field of Classification Search
CPC ..... E05B 81/16; E05B 81/90; E05B 77/26; E05B 77/28; E05B 77/283; E05B 85/06; Y10T 292/1047; Y10T 292/1082; Y10S 292/65
See application file for complete search history.

(56) References Cited

U.S. PATENT DOCUMENTS 6,634,682 B2 * 10/2003 Fukunaga ..... E05B 85/02 292/216
2002/0050156 A1 * 5/2002 Kobayashi ..... E05B 77/28 70/237
2010/0212374 A1 8/2010 Fujihara
2012/0061976 A1 * 3/2012 Tostado ..... E05B 81/34 292/200
2017/0350170 A1 * 12/2017 Cetnar ..... E05B 77/26
2017/0356221 A1 12/2017 Pettengill
2019/0161996 A1 * 5/2019 Taurasi ..... E05B 81/06
2020/0347649 A1 11/2020 Nam et al.

FOREIGN PATENT DOCUMENTS

DE 102019128484 A1 11/2020
JP 2001241249 A * 9/2001
JP 2001241249 A 9/2001

OTHER PUBLICATIONS

Machine translation and numbered paragraphs version of JP2001241249A (Year: 2001).*
European Search Report for European Application No. 22158808; Date of Completion: Jul. 20, 2022; 3 Pages.
Chinese Office Action for Chinese Application No. 202121182981.8 dated Dec. 15, 2021.
Communication pursuant to Article 94(3) EPC dated May 4, 2023; European Application No. 22158808.0; 3 Pages.

* cited by examiner

*Primary Examiner* — Christine M Mills
*Assistant Examiner* — Christopher F Callahan
(74) *Attorney, Agent, or Firm* — CANTOR COLBURN LLP

(57) ABSTRACT

A vehicle latch, including: an override mechanism, the override mechanism having: a central door lock sector; a double lock sector; a double lock link, the double lock link operably coupling the central door lock sector to the double lock sector; a key cylinder; and a key cylinder link, the key cylinder link operably coupling the key cylinder to the central door lock sector.

14 Claims, 4 Drawing Sheets

VEHICLE DOOR LATCH WITH OVERRIDE FEATURE

BACKGROUND

Exemplary embodiments of the present disclosure pertain to the art of vehicle door latches.

Vehicle door latches include features that allow the latch to be in a locked state where operation of a handle operably coupled to the latch does not cause the latch to be operated (e.g., open). In some applications, the vehicle latch is moved from the locked state to an unlock state via an electric motor. In the event of power loss to the vehicle and/or the latch a manual operation of the latch is also required.

As such, it is desirable to provide an improved vehicle door latch that can be manipulated between a locked and unlocked state.

BRIEF DESCRIPTION

Disclosed is a vehicle latch, including: an override mechanism, the override mechanism having: a central door lock sector; a double lock sector; a double lock link, the double lock link operably coupling the central door lock sector to the double lock sector; a key cylinder; and a key cylinder link, the key cylinder link operably coupling the key cylinder to the central door lock sector.

In addition to one or more of the features described above, or as an alternative to any of the foregoing embodiments, the vehicle latch also includes: an inside release lever; an inside release bypass lever; and a child lock link moveably mounted to the inside release bypass lever, the child lock link being moveable between a by-pass position and a full engaged position, when the child lock link is in the full engaged position, the inside release lever interacts and moves the inside release bypass lever through a protrusion of the child lock link that is located between portions of the inside release lever and the inside release bypass lever and wherein the protrusion of the child lock link is not located between the portions of the inside release lever and the inside release bypass lever when the child lock link is in the by-pass position.

In addition to one or more of the features described above, or as an alternative to any of the foregoing embodiments, the double lock sector is rotationally mounted to an actuator housing and the central door lock sector is rotationally mounted to the actuator housing.

In addition to one or more of the features described above, or as an alternative to any of the foregoing embodiments, the double lock link is pivotally secured to the double lock sector and the central door lock sector via a protrusion of the double lock sector that slides within an elongated opening of the double lock link.

In addition to one or more of the features described above, or as an alternative to any of the foregoing embodiments, the elongated opening has a curved configuration.

In addition to one or more of the features described above, or as an alternative to any of the foregoing embodiments, the key cylinder is rotatably mounted to the actuator housing and the key cylinder link is pivotally connected to the central door lock sector at one end and the key cylinder at an opposite end.

In addition to one or more of the features described above, or as an alternative to any of the foregoing embodiments, the double lock sector is rotationally mounted to an actuator housing and the central door lock sector is rotationally mounted to the actuator housing.

In addition to one or more of the features described above, or as an alternative to any of the foregoing embodiments, the double lock link is pivotally secured to the double lock sector and the central door lock sector via a protrusion of the double lock sector that slides within an elongated opening of the double lock link.

In addition to one or more of the features described above, or as an alternative to any of the foregoing embodiments, the elongated opening has a curved configuration.

In addition to one or more of the features described above, or as an alternative to any of the foregoing embodiments, the key cylinder is rotatably mounted to the actuator housing and the key cylinder link is pivotally connected to the central door lock sector at one end and the key cylinder at an opposite end.

In addition to one or more of the features described above, or as an alternative to any of the foregoing embodiments, the double lock link is pivotally secured to the double lock sector and the central door lock sector via a protrusion of the double lock sector that slides within an elongated opening of the double lock link.

In addition to one or more of the features described above, or as an alternative to any of the foregoing embodiments, the elongated opening has a curved configuration.

In addition to one or more of the features described above, or as an alternative to any of the foregoing embodiments, the key cylinder is rotatably mounted to the actuator housing and the key cylinder link is pivotally connected to the central door lock sector at one end and the key cylinder at an opposite end.

In addition to one or more of the features described above, or as an alternative to any of the foregoing embodiments, the key cylinder is rotatably mounted to the actuator housing and the key cylinder link is pivotally connected to the central door lock sector at one end and the key cylinder at an opposite end.

Also disclosed is a method of manually overriding a vehicle latch, the method including the steps of: rotating a key cylinder of the latch, a key cylinder link operably couples the key cylinder to a central door lock sector of the latch, the central door lock sector being operably coupled to a double lock sector by a double lock link, wherein rotation of the key cylinder causes a child lock link to move between a by-pass position and a full engaged position, when the child lock link is in the full engaged position, an inside release lever interacts and moves an inside release bypass lever through a protrusion of the child lock link that is located between portions of the inside release lever and the inside release bypass lever and wherein the protrusion of the child lock link is not located between the portions of the inside release lever and the inside release bypass lever when the child lock link is in the by-pass position.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
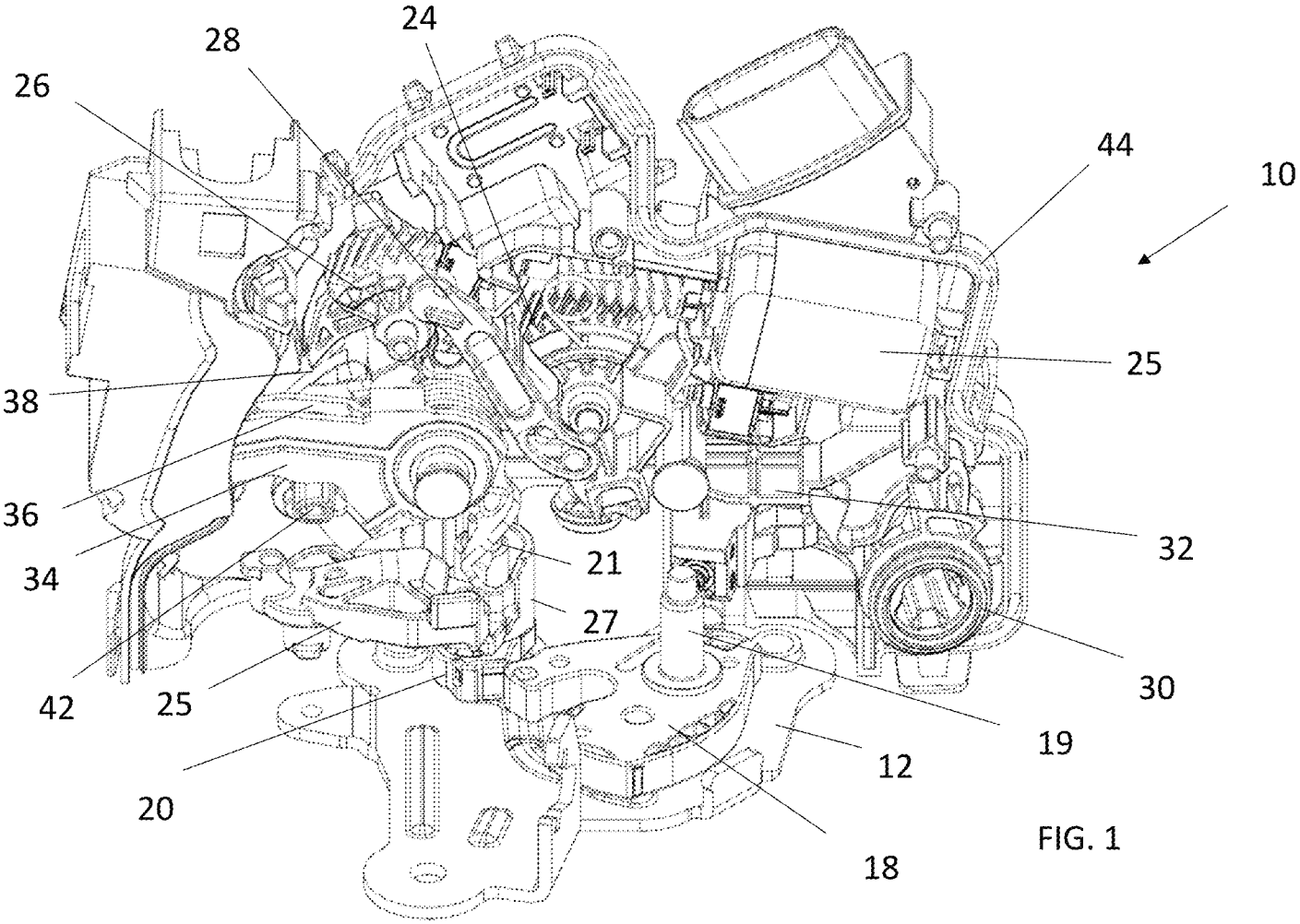
FIG. 1 is perspective view of a vehicle latch in accordance with an embodiment of the present disclosure.
Figure 2:
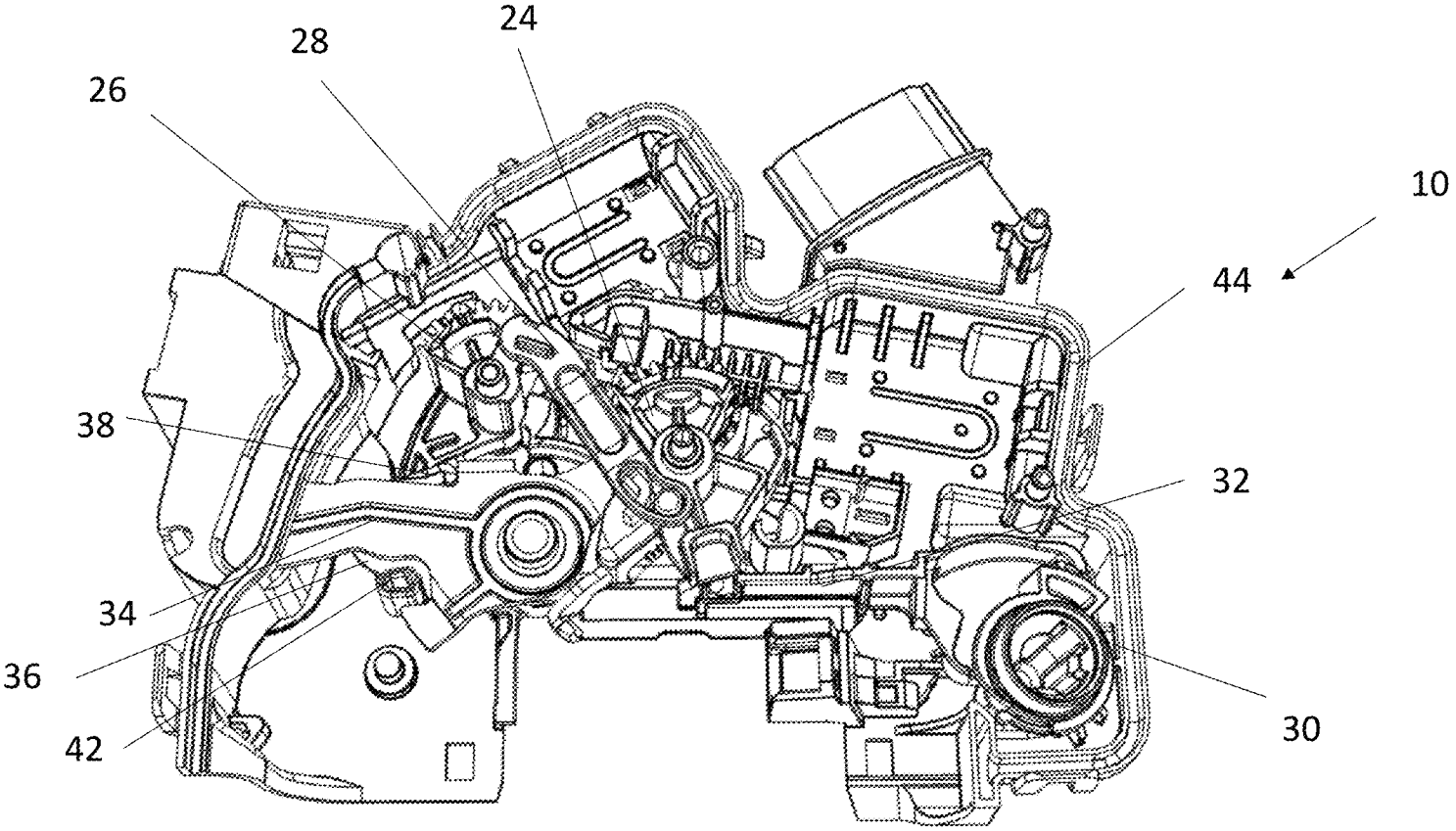
FIG. 2 is a view of components of a vehicle latch that is common for use with cable and rod operated mechanisms in accordance with an embodiment of the present disclosure, wherein the latch is in an engaged primary position and a rod is secured thereto.
Figure 3:
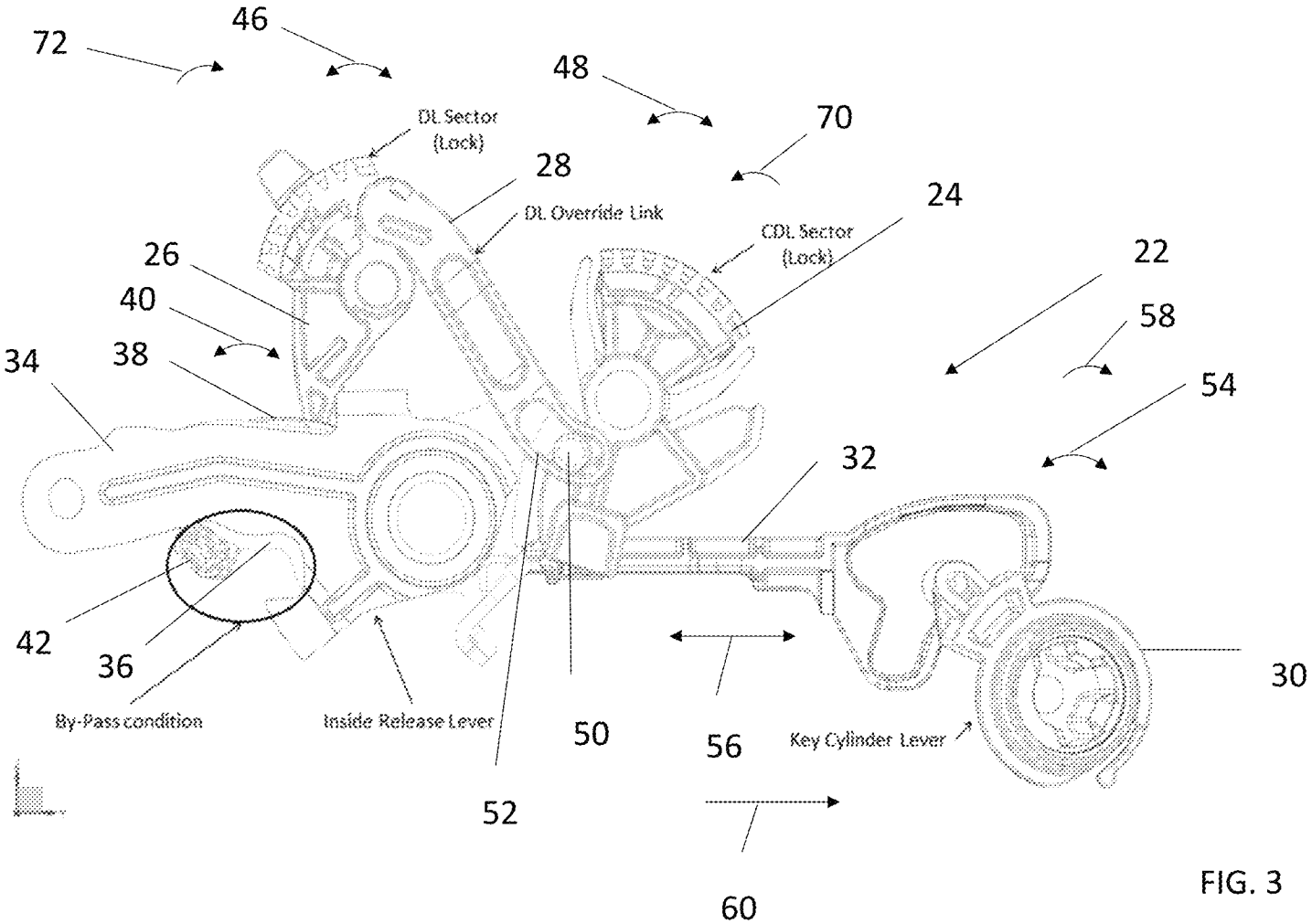
FIG. 3 is a view of components of the vehicle latch in a door locked position.

FIGS. 1 and 2 are perspective views of a vehicle latch 10 in accordance with an embodiment of the present disclosure. The vehicle latch 10 has a retention plate 12, a housing (not shown), actuator housing 14 and a cover (not shown).

The latch 10 also has a claw 18 and a pawl 20 each being pivotally mounted to the retention plate 12. The claw 18 is capable of rotation about a first stud or pin 19 and the claw is configured to engage and retain a striker (not shown) when it is received in the latch 10. The pawl 20 is a capable of rotation about a second stud or pin 21.

The claw 18 is capable of movement between a first or latched position or closed position or primary position wherein the striker is engaged by a throat of the claw 18 and a second or open position wherein the striker is free to be released from the throat of the claw 18. The retention plate 12 will also have a complimentary opening for receipt of the striker therein when it is engaged or latched by the claw 18. In one embodiment, the claw 18 may be spring biased into the second or open position by a spring or biasing member.

Alternatively or in addition to the spring biasing force applied to the claw, a movable member (e.g., door, panel, lift gate, etc.) the latch is secured to may also be spring biased or biased into an open position such that when the latch 10 is released claw 18 will rotate and release striker. One non-limiting example of an item providing such a force is the compressed weather stripping or sealing member located around the periphery of an opening that is covered by the movable member. In other words, when a vehicle door or other movable member is closed, the sealing member is compressed and the latch 10 engages the striker. Thereafter and when the latch 10 is released, the sealing member may provide an urging force to open the door or gate, etc.

During operation and in order to retain the latch 10 or claw 18 in the latched position, the pawl 20 is pivotally secured to the latch 10 for movement between an engaged position or latched position and a disengaged position or released position. When the pawl 20 is in the engaged position, a surface of the claw 18 is engaged by a surface of the pawl 20 and the claw 18 is prevented from moving toward the unlatched position from the latched position.

In one non-limiting implementation, a first spring may be provided for biasing the claw into the open position while a second spring may be provided for biasing the claw in the direction of the engaged position, such that movement of the claw to the latched position will cause the pawl to move to the engaged position.

Referring now to FIGS. 1-4 portions of an override mechanism 22 in accordance with the present disclosure. The override mechanism 22 includes a central door lock sector 24, a double lock sector 26, a double lock link 28, a key cylinder 30 and a key cylinder link 32. Also illustrated is an inside release lever 34, an inside release bypass lever 36, and a child lock link 38.

Figure 4:
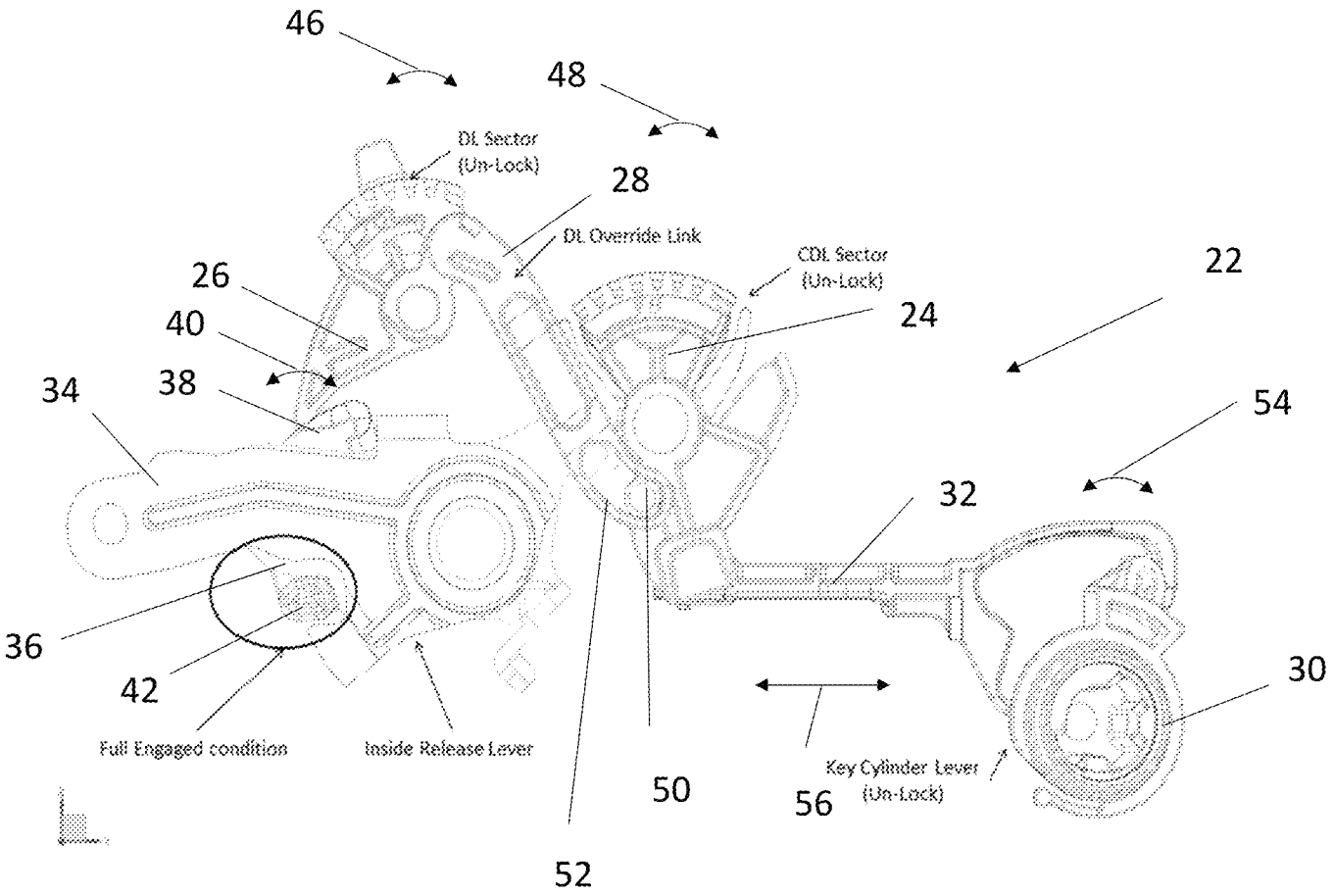
FIG. 4 is a view of components of the vehicle latch in a door unlocked position.

The child lock link 38 is mounted on the inside release bypass lever 36 and it can rotate around a mounting pivot hole on the inside release bypass lever 36. When the child lock link 38 is rotated in the directions of arrows 40, it moves between a by-pass condition or by-pass condition position (FIG. 3) and a full engaged condition or full engaged position (FIG. 4).

When the child lock link 38 is in the full engaged condition or full engaged position (FIG. 4), the inside release lever 34 interacts and moves the inside release bypass lever 36 through a protrusion 42 of the child lock link 38 that is located between portions of the inside release lever 34 and the inside release bypass lever 36 such that movement of the inside release lever 34 will cause movement of the inside release bypass lever 36, which in turn will cause movement of the pawl 20 as the inside release bypass lever 36 is operably coupled to the pawl via one or more components 25, 27.

On the other hand, when the child lock link 38 is in the by-pass condition or by-pass position (FIG. 3), the inside release lever 34 is not able to mechanically interact and move the inside release bypass lever 36 as the child lock link 38 is in the by-pass condition or by-pass position. Movement of the inside release lever 34 is facilitated through actuation of a vehicle inside release handle operably coupled the inside release lever 34.

The double lock sector 26 is pivotally or rotationally mounted to an actuator housing 44 such that it can move in the directions of arrows 46 and provide the desired movement of the child lock link 38 in the direction of arrows 40. In one operation, the movement of the double lock sector 26 is achieved via a motor (not shown) operably coupled to the double lock sector 26. As illustrated, the double lock sector 26 has a plurality of teeth for meshing with a worm of the motor.

The central door lock sector 24 is pivotally or rotationally mounted to the actuator housing 44 such that it can move in the directions of arrows 48. As illustrated, the double lock link 28 operably couples the double lock sector 26 to the central door lock sector 24.

The double lock link 28 is pivotally secured to the double lock sector 26 at one end and the double lock link is pivotally secured to the central door lock sector 24 at another via a protrusion 50 of the double lock sector 26 that slides within an elongated opening 52 of the double lock link 28. In one embodiment, the elongated opening 52 has an arcuate or curved configuration.

In one operation, the movement of the central door lock sector 24 is achieved via a motor 25 operably coupled to the central door lock sector 24. As illustrated, the central door lock sector 24 has a plurality of teeth for meshing with a worm of the motor 25.

The key cylinder 30 is rotatably mounted to the actuator housing 44 for movement in the direction of arrows 54, which in turn causes the key cylinder link 32 to translate in the direction of arrows 56, which causes movement of the central door lock sector 24 in the direction of arrows 48. This is due to the key cylinder link 32 being pivotally connected to the central door lock sector 24 at one end and the key cylinder 30 at an opposite end. Movement of the key cylinder 30 in the direction of arrows 54 is achieved via a key that is inserted into the vehicle latch 10 from an outside of the vehicle. This is particularly useful in the event that the motors operably coupled to the central door lock sector 24 and the double lock sector 26 lose power. As such, an operator of the vehicle may unlock the latch 10 by inserting a key into the key cylinder and rotating it to cause the required movement of the child lock link 38.

In one operation and in order to translate the child lock link 38 from the by-pass condition or by-pass position in (FIG. 3) to the full engaged condition or full engaged position (FIG. 4), the key cylinder lever 30 is rotated in the direction of arrow 58, which causes movement of the key cylinder link 32 in the direction of arrow 60, which causes rotation of the central door lock sector 24 in the direction of arrow 70, which in turn causes rotation of the double lock sector 26 in the direction of arrow 72 due to double lock link 28 operably coupling the central door lock sector 24 to the double lock sector 26.

As such, a manual override system is provided via key cylinder 30, which is particularly useful in the event of a power loss to the latch 10.

The term "about" is intended to include the degree of error associated with measurement of the particular quantity based upon the equipment available at the time of filing the application. For example, "about" can include a range of ±8% or 5%, or 2% of a given value.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A vehicle latch, comprising:

an override mechanism, the override mechanism having:

a central door lock sector;

a double lock sector;

a double lock link, the double lock link operably coupling the central door lock sector to the double lock sector, the double lock link being pivotally secured to the double lock sector at one end and the central door lock sector at another end via a protrusion of the double lock sector that slides within an elongated opening of the double lock link;

a key cylinder; and a key cylinder link, the key cylinder link operably coupling the key cylinder to the central door lock sector.

2. The vehicle latch as in claim 1, further comprising:

an inside release lever;

an inside release bypass lever; and a child lock link moveably mounted to the inside release bypass lever, the child lock link being moveable between a by-pass position and a full engaged position, when the child lock link is in the full engaged position, the inside release lever interacts and moves the inside release bypass lever through a protrusion of the child lock link that is located between portions of the inside release lever and the inside release bypass lever and wherein the protrusion of the child lock link is not located between the portions of the inside release lever and the inside release bypass lever when the child lock link is in the by-pass position.

3. The vehicle latch as in claim 2, wherein the double lock sector is rotationally mounted to an actuator housing and the central door lock sector is rotationally mounted to the actuator housing.

4. The vehicle latch as in claim 2, wherein the key cylinder is rotatably mounted to an actuator housing and the key cylinder link is pivotally connected to the central door lock sector at one end and the key cylinder at an opposite end.

5. The vehicle latch as in claim 1, wherein the double lock sector is rotationally mounted to an actuator housing and the central door lock sector is rotationally mounted to the actuator housing.

6. The vehicle latch as in claim 5, wherein the key cylinder is rotatably mounted to the actuator housing and the key cylinder link is pivotally connected to the central door lock sector at one end and the key cylinder at an opposite end.

7. The vehicle latch as in claim 1, wherein the elongated opening has a curved configuration.

8. The vehicle latch as in claim 1, wherein the key cylinder is rotatably mounted to an actuator housing and the key cylinder link is pivotally connected to the central door lock sector at one end and the key cylinder at an opposite end.

9. A method of manually overriding a vehicle latch, comprising:

rotating a key cylinder of the latch, a key cylinder link operably couples the key cylinder to a central door lock sector of the latch, the central door lock sector being operably coupled to a double lock sector by a double lock link, the double lock link being pivotally secured to the double lock sector at one end and the central door lock sector at another end via a protrusion of the double lock sector that slides within an elongated opening of the double lock link, wherein rotation of the key cylinder causes a child lock link to move between a by-pass position and a full engaged position, when the child lock link is in the full engaged position, an inside release lever interacts and moves an inside release bypass lever through a protrusion of the child lock link that is located between portions of the inside release lever and the inside release bypass lever and wherein the protrusion of the child lock link is not located between the portions of the inside release lever and the inside release bypass lever when the child lock link is in the by-pass position.

10. The method as in claim 9, wherein the double lock sector is rotationally mounted to an actuator housing and the central door lock sector is rotationally mounted to the actuator housing.

11. The method as in claim 10, wherein the elongated opening has a curved configuration.

12. The method as in claim 11, wherein the key cylinder is rotatably mounted to the actuator housing and the key cylinder link is pivotally connected to the central door lock sector at one end and the key cylinder at an opposite end.

13. The method as in claim 9, wherein the elongated opening has a curved configuration.

14. The method as in claim 9, wherein the key cylinder is rotatably mounted to an actuator housing and the key cylinder link is pivotally connected to the central door lock sector at one end and the key cylinder at an opposite end.

* * * * *